PTC-912 SP
1/29/86 XP 4,566,912

United States Patent [19]

Borg

[11] Patent Number: 4,566,912

[45] Date of Patent: Jan. 28, 1986

[54] METHOD OF REGENERATING ALKALI-CONTAINING WASH SOLUTIONS UTILIZED FOR CLEANING CONTAINERS

[75] Inventor: Siegbert Borg, Bingen, Fed. Rep. of Germany

[73] Assignee: Seitz Enzinger Noll Maschinenbau Aktiengesellschaft, Mannheim, Fed. Rep. of Germany

[21] Appl. No.: 609,449

[22] Filed: May 11, 1984

[30] Foreign Application Priority Data

May 13, 1983 [DE] Fed. Rep. of Germany ..... 3317571

[51] Int. Cl.[4] ..... B08B 7/04

[52] U.S. Cl. ..... 134/13; 210/712; 210/912

[58] Field of Search ..... 210/912, 712, 723-728; 134/10, 13

[56] References Cited

U.S. PATENT DOCUMENTS

| | | | |
|---|---|---|---|
| 3,816,306 | 6/1974 | Roy | 210/912 X |
| 4,124,504 | 11/1978 | Munden | 210/912 X |
| 4,350,597 | 9/1982 | Selm et al. | 210/912 X |
| 4,390,431 | 6/1983 | Amigues et al. | 210/912 X |
| 4,434,060 | 2/1984 | Altmansberger et al. | 210/912 X |
| 4,465,598 | 8/1984 | Darlington et al. | 210/912 X |

*Primary Examiner*—Thomas Wyse
*Attorney, Agent, or Firm*—Becker & Becker, Inc.

[57] ABSTRACT

Separation of dissolved aluminum, copper, and other heavy metals and/or carbonates from sodium hydroxide or potassium hydroxide containing wash solutions utilized during the mechanical cleaning of metal-clad containers, especially bottles. This separation is accomplished by adding calcium compounds and separating off the thereby formed precipitates from the wash solution. The specific calcium compound is added to the wash solution directly in the form of a solid compound. Calcium oxide or calcium hydroxide are preferably used as the calcium compounds, and are primarily added directly to the wash solution as a solid.

8 Claims, 1 Drawing Figure

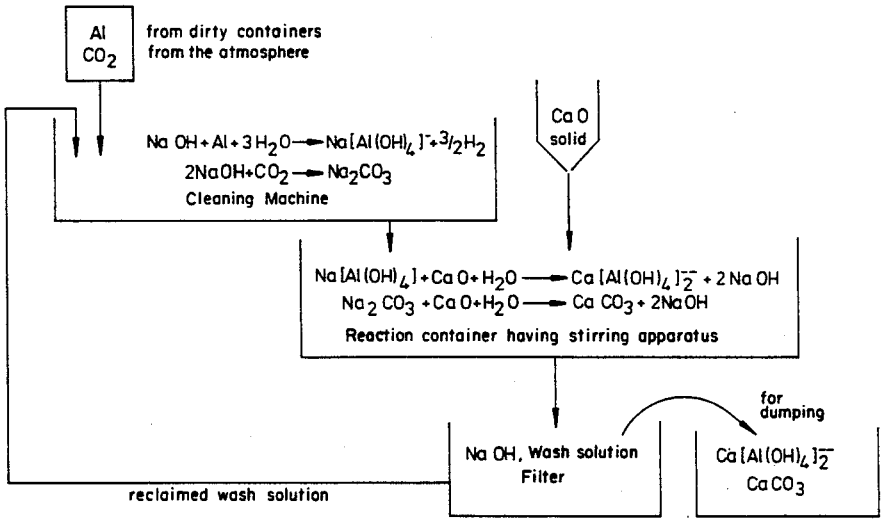

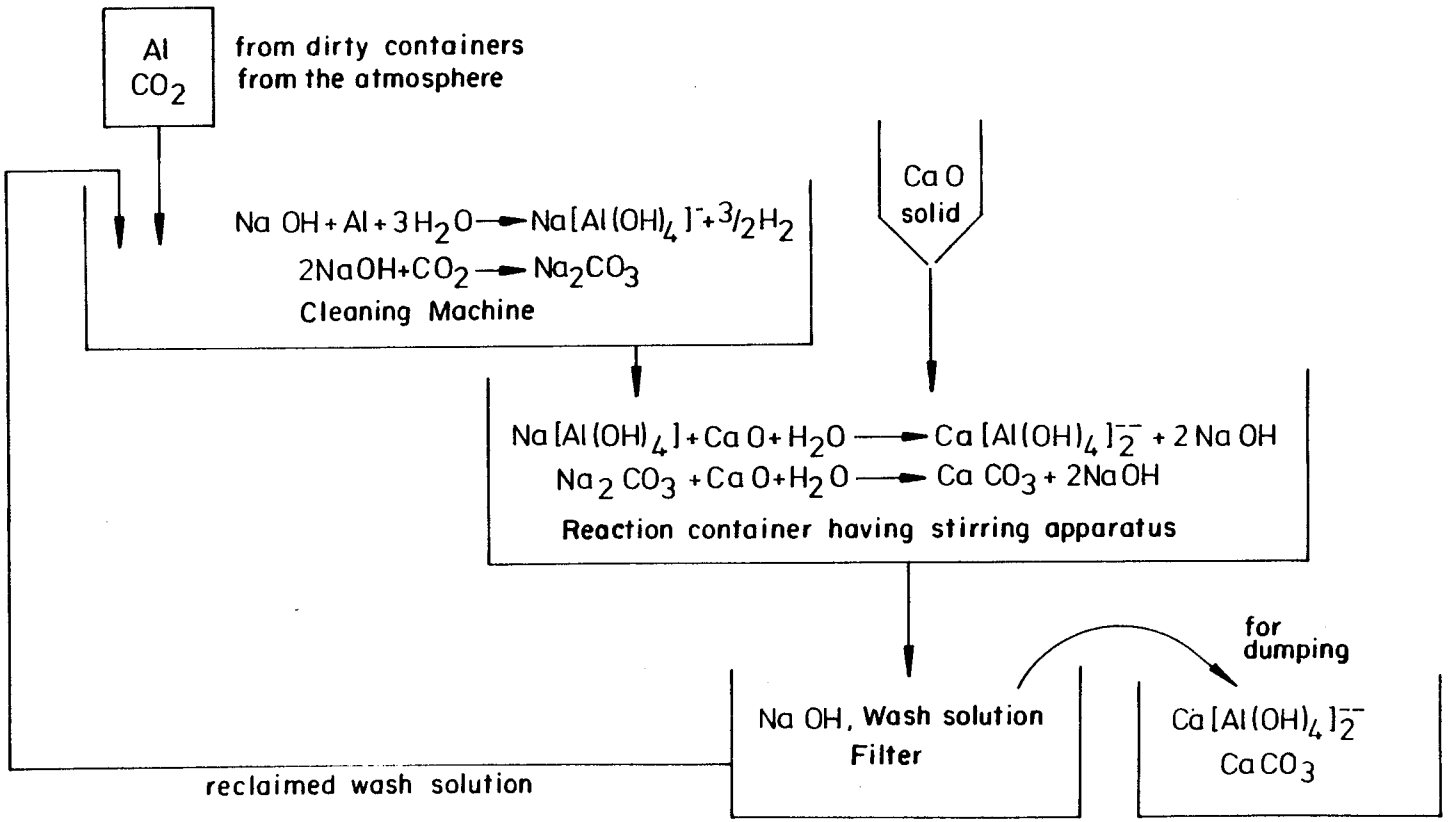
Al
$CO_2$
from dirty containers
from the atmosphere
$NaOH + Al + 3H_2O \rightarrow Na[Al(OH)_4]^- + 3/2 H_2$
$2NaOH + CO_2 \rightarrow Na_2CO_3$
Cleaning Machine
Ca O
solid
$Na[Al(OH)_4] + CaO + H_2O \rightarrow Ca[Al(OH)_4]_2^{--} + 2NaOH$
$Na_2CO_3 + CaO + H_2O \rightarrow CaCO_3 + 2NaOH$
Reaction container having stirring apparatus
NaOH, Wash solution
Filter
for
dumping
$Ca[Al(OH)_4]_2^{--}$
$CaCO_3$
reclaimed wash solution

METHOD OF REGENERATING ALKALI-CONTAINING WASH SOLUTIONS UTILIZED FOR CLEANING CONTAINERS

BACKGROUND OF THE INVENTION

1. Field of the Invention

The present Invention relates to a method of regenerating or reclaiming wash liquors or solutions which contain alkali, such as sodium hydroxide and/or potassium hydroxide, and which are used during the mechanical cleaning of containers, especially bottles. The wash solution can contain, as impurities, dissolved aluminum, copper, other heavy metal in the form of zinc, iron, nickel, or lead, which originate from the composition of the container, and/or carbonates which result during the mechanical cleaning, as well as organic substances which adhere to the container. The reclaiming is accomplished by adding calcium compounds to such wash solutions, and separating the thus formed precipitates from the wash solutions.

2. Description of the Prior Art

Before a reuseable empty beverage container, for example in the form of a bottle, is reused, it is mechanically washed utilizing cleansing agents which customarily contain sodium hydroxide as a cleansing aid, but can additionally or in place thereof also contain potassium hydroxide. If the empty container contains aluminum, for example as a result of aluminum-containing add-ons, such as aluminum foils, or aluminum-containing labels, this aluminum is then subjected to strong corrosion from the action of these hydroxides or lyes. This reaction between aluminum and alkali solution leads to the formation of alkali aluminate along with hydrogen. This reaction is particularly undesirable to the extent that it consumes alkali solution which is needed as cleansing agent. Depending upon the position and shifting of the equilibrium (for example when exceeding a maximum aluminum concentration), aluminum hydroxide can also be precipitated, and difficult-to-remove deposits can be formed in the cleaning machines. Under unfavorable conditions, difficult-to-remove residues can even result on the empty beverage container which is to be cleaned; with glass bottles, this can lead to so-called gray bottles.

A similar situation is encountered during the cleaning of empty beverage containers which contain copper or other heavy metals, such as zinc, iron, nickel, or lead, which also originate from the labels or the like.

Thus, the used wash solution resulting during the cleaning of empty beverage containers dissolved form, and depending upon the type of label or the like, can contain one or more of the aforementioned metals in a more or less great concentration.

As a result of carbon dioxide being pulled-in from the atmosphere and the dirty empty beverage container, alkali carbonates are also formed during the wash process by means of the alkali solutions, as a result of which cleansing agent is again consumed and deposits or precipitates can be formed.

Of course, the empty beverage container which is to be cleaned also contains organic substances which originate mainly from the residue of the beverage, and which also accumulate in the used wash solution. These substances lead to an undesirable increase of the so-called COR value (value for the chemical oxygen requirement), which represents a measurement for the degree of contamination of waste water containing organic impurities in particular. The official requirements, which continuously become stricter with regard to the permissible degree of impurities in waste water that can be supplied to the sewers or other means of removal, therefore also in this case require measures via of which such substances also at least to some extent can be separated from the used wash solution of the type presently under consideration.

In addition to the already very undesirable formation of deposits in the cleaning equipment, and possibly also in the goods which are to be cleaned, all of these reactions also have as a consequence that the wash solutions are thereby consumed relatively rapidly and become ineffective. This implies not only an unnecessarily high use of working material such as alkali solutions and energy, but also a high waste water charging with the known consequences of great environmental pollution or high costs for waste water treatment. A reduction of the waste water loading by increasing the life of the wash solution, namely by suitable measures for solution treatment and reuse of the solution while at the same time reducing the salt charge in the completely used-up wash solution which is finally supplied to the waste water sewer, would therefore include great advantages if hereby at the same time the problem of formation of undesirable deposits in the cleaning equipment also could be eliminated.

In consequence of the above described problems, a series of methods have already been proposed by means of which the aluminum-containing, more or less consumed cleaning solution that is produced during the mechanical cleaning of a reuseable empty beverage container can be continuously or intermittently treated (see, for example, German Offenlegungsschrift No. 29 20 737). Various other possibilities have been proposed for removing the aluminum dissolved in such wash solutions, for example by converting the alkali aluminate into insoluble aluminum hydroxide by means of seeding with $\gamma$ - aluminum hydroxide. A particularly interesting manner of removing the undesirable alkali aluminate consists in converting the dissolved alkali aluminate into insoluble calcium aluminate, and subsequently separating the latter from the wash solution using known methods, for example filtration. For this purpose, the alkali-aluminate-containing wash solution is diluted with a solution of calcium oxide which, for facilitating and improving the desired precipitation, preferably also contains a polyelectrolyte. The addition of this calcium oxide solution, and the separation of the precipitating insoluble calcium aluminate, can be carried out continuously or intermittently, with a continuous manner of operation being preferred. Together with this procedure, the dissolved carbonates, for example sodium carbonate or potassium carbonate, found in the wash solution are converted into insoluble calcium carbonate, which can then also be separated from the wash solution together with the insoluble calcium aluminates. Thus, in a closed cycle method, the undesirable aluminates and carbonates can be separated from the wash solution in the washing process. Thus the solution can be used for a longer period of time, and the problems of formation of undesirable deposits in the cleaning machines and on the cleaned containers can be practically eliminated.

However, despite disadvantages, this method has the considerable drawback that for precipitation of the alkali aluminates and alkali carbonates, which are dissolved in the wash solution, in the form of insoluble calcium salts, a solution of calcium oxide must be added. This results in a rather significant dilution of the wash solution, so that the washing strength of such a solution is continuously reduced, and, after a relatively short period of time, the washing strength thereof is totally insufficient. Parallel to this, of course, is the continuous reduction of the ability of the aluminum contained in the container labels to be dissolved. Due to the increasing dilution, after a period of time the extent of precipitation of the dissolved aluminates and carbonates is also reduced, whereby the quantity of waste water to be supplied to the sewer system becomes increasingly greater. In addition, since the wash solutions for achieving an optimum washing effect normally require a temperature of approximately 60° to 80° C., the solution of calcium oxide required for precipitation of insoluble calcium salts additionally must be heated up to this temperature, thus involving increasingly higher costs as the close cycle process continues.

The aforementioned drawbacks of the method of German Offenlegungsschrift No. 29 20 737, are due to the necessity for using an aqueous solution of calcium oxide, and which concern reduction of the washing capability, of the ability to dissolve aluminum, and of the precipitation, of the dissolved alkali aluminates and alkali carbonates. These drawbacks can be somewhat overcome by counteracting their cause, namely the constantly increasing dilution of the wash solution. The drawbacks are counteracted by continuously or intermittently concentrating the diluted wash solution by evaporating the excess water. However, not inconsiderable costs are connected herewith as a result of the necessary additional expense for apparatus and energy. The favorable resolving of a problem is thus diminished or even entirely eliminated by the aforementioned method. However, the method or interest from the standpoint of its solution, namely the conversion of the dissolved aluminate and carbonate contained in the wash solution in question into insoluble calcium aluminate and calcium carbonate by the use of a calcium oxide solution. The method, unfortunately, as a consequence of the aforementioned comments, has drawbacks which appear to make this method anything but economical.

It is therefore an object of the present invention to develop this method further and in such a way that full use can be made of the advantageous features, while at the same time practically eliminating the drawbacks thereof. It is a further object of the present invention that it be possible with such a method to not only separate dissolved aluminates and carbonates from the used wash solution, but also to separate other dissolved metals, especially heavy metals such as copper, zinc, iron, nickel, and/or lead. Also, here is obtained therewith additional result of a reduction of the so-called COR valve of the used solution by means of a simultaneous, at least partial co-separation of organic impurities.

BRIEF DESCRIPTION OF THE DRAWING

These objects, and other objects and advantages of the present invention, will appear more clearly from the following specification in conjunction with the accompanying drawing, which is a flow diagram illustrating reactions of the inventive method.

SUMMARY OF AND BEST MODES FOR CARRYING OUT THE INVENTION

The method of the present invention is characterized primarily by adding the respective calcium compound directly to the wash solution in the form of a solid calcium compound or an aqueous suspension thereof.

The successful applicability of the inventive method is particularly surprising to the extent that an expert in this area must start from the fact that solid calcium compounds, as they also are contained partially in appropriately concentrated aqueous suspensions, do not dissolve to the required extent in the sodium hydroxide and/or potassium hydroxide-containing wash solutions used for cleaning the metal-containing (e.g. via labels) containers. This is especially true since the solubility of solid calcium compounds decreases very rapidly as the temperature rises and as the alkalinity of alkali-containing solutions increases. For example, calcium oxide is insoluble in hot sodium hydroxide. Practically only small traces of calcium oxide dissolve in a warm 2% sodium hydroxide solution which is at 75° C. The solubility of calcium therein is less than 0.03%. The impurity, which to a certain extent is achieved by the introduction of calcium oxide into sodium hydroxide, is still less than the purity which can be achieved with most substances for analysis. The purity of such a solution relative to the original sodium hydroxide is still greater than 99.97%. These principles for calcium oxide and calcium hydroxide are explained in greater detail in Ullmanns Encyklopädie der technischen Chemie, volume 9 (1957), page 242. The basic reaction of the method under discussion between a solid calcium compound, or an aqueous suspension thereof, especially calcium hydroxide or calcium oxide, and an alkali-containing wash solution of the type under discussion is therefore theoretically impossible. This is also the reason why German Offenlegungsschrift No. 29 20 737 does not start with solid calcium oxide, or appropriately concentrated aqueous suspension thereof, but rather starts with an aqueous solution of calcium oxide. Thus, via the detour of first forming a calcium oxide solution, this heretofore known method bypasses the problem recognized by the experts of the insolubility of solid calcium oxide in alkali solutions, and especially in warm alkali solutions. Thus, while overcoming the opinion of the technical world, the method of the present invention is based on the realization that the method from German Offenlegungsschrift No. 29 20 737, instead of by means of an aqueous calcium oxide solution, surprisingly also can be carried out directly using the solid calcium compound, or an aqueous suspension thereof. The special advantages resulting herefrom are obvious, and will be described in greater detail subsequently.

As described above, the inventive method, in general, can be carried out by the addition of a calcium compound directly in the form of a solid calcium compound or an aqueous suspension thereof. Organic as well as inorganic calcium compounds can be used. Calcium acetate is an example of a suitable organic calcium compound. However, inorganic calcium compounds are particularly suitable, such as calcium hydroxide and, above all calcium oxide. Calcium chloride or calcium sulfate could also be used, but there are not as suitable as calcium oxide or calcium hydroxide. This is so because during their reaction with the dissolved aluminates and carbonates which are to be precipitated, both of the former use up alkali wash solution due to their anion constituents, as a result of which the washing capacity of the wash solution which is to be reclaimed is affected. Furthermore, calcium chloride can lead to corrosion problems due to its chloride content. During the reaction in question, neither calcium hydroxide nor calcium oxide produces desirable anions and hence an adverse effect of the alkali solution content of the respective wash solution; thus, they are particularly preferred for the present inventive method. They are primarily used directly in the form of the respective solid compound, since addition in this form leads to no dilution of the wash solution, which dilution would be connected with drawbacks for the reasons described previously. It is just this use of calcium oxide in solid form that, above all other possible calcium compounds, and of course also relative to the otherwise very effective calcium hydroxide, offers the particular advantage that its reaction with water is connected with the known high production of heat from the slaking of the calcium oxide. This results in a very considerable saving of energy during the generally required heating of the wash solution required for mechanical cleaning of the respective aluminum-labeled containers. During the reaction of the dissolved aluminates and carbonates, which are to be separated off and are found in the respective wash solution, with calcium oxide or even calcium hydroxide, in addition to the insoluble calcium aluminates and calcium carbonates, which are absolutely necessary for the desired separation, the corresponding alkali hydroxide is regenerated. The percentage of the alkali hydroxide found in the wash solution is therefore not reduced by the inventive method, so that the end effect is that the wash solution maintains its original cleaning capacity. There is absolutely no dilution of the wash solution with water, since the calcium compound is added to the wash solution directly in the form of a solid calcium compound or in the form of a highly concentrated aqueous suspension. A similar situation exists for the separation of copper and other heavy metals. In such cases, insoluble basic carbonates, double carbonates, oxide hydrates, or hydroxides are formed in the wash solution, with the alkali hydroxide being at least partially regenerated.

The inventive method can be readily integrated into conventional cleaning equipment for reuseable empty beverage containers, such as bottles, by continuously withdrawing a certain partial flow from the wash solution which is to be treated, and is contained, for example, in a cleaning bath. The specific calcium compound is added to this partial flow either directly in solid form or in the form of an aqueous suspension. After an appropriate reaction time, the resulting insoluble precipitates, such as solid calcium aluminate or calcium carbonate, are continuously removed by conveying the partial flow through a suitable filter system. The partial flow freed from the insoluble precipitates is conveyed back into the bath. Instead of withdrawing a partial flow, the entire wash solution can also be drawn off from the bath into a container after termination of operation, and can then be treated with the specific calcium compound. After a certain reaction time, the wash solution can be freed from the precipitating solid calcium salts, and can be returned to the bath prior to the start of the next operation. However, the inventive method is best carried out continuously with a partial flow. An intermittent method of operation, for example utilizing an appropriate reaction container and sufficient retention times, as well as filter equipment, is of course also possible.

For regenerating an aluminum-loaded and carbonate-containing wash solution, the procedural and chemical progress of the inventive method, as illustrated in the flow diagram of the accompanying drawing, proceeds on the basis of sodium hydroxide as wash solution and also on the basis of the use of solid calcium oxide as the calcium compound. Instead of sodium hydroxide, potassium hydroxide, of course, also could be used just as well, or a mixture of sodium hydroxide and potassium hydroxide could be used. Instead of solid calcium oxide, solid calcium hydroxide or some other suitable solid calcium compound (inorganic or organic) could be used. Finally, concentrated aqueous suspensions of the specific calcium compound could also be used. At the present time, there are most commonly used aluminum-containing labels and the like for beverage containers, especially bottles. Thus, there is to be noted that consequently there is encountered mainly aluminates that are released from such labels and that precipitate or fall into the alkali hydroxide containing wash solutions. In addition to the carbonates which are also present in the containers, these aluminates, pursuant to the inventive method, are then separated in the form of suitable insoluble precipitates. The solid calcium compound, especially calcium oxide, which is used to form these precipitates, and which after contamination of the wash solution is added thereto at the rate of 15 to 40 grams per liter, in conjunction with the precipitates, at the same time also can act as a coagulation agent for the organic impurities contained in such used wash solutions, so that these impurities are also at least partially precipitated. Furthermore, the precipitates also act to a certain extent as adsorbents and filtering aids, especially for the organic impurities as such, or in coagulated form; this contributes to a further improvement of the separation of these impurities.

In a manner similar to that described above, it is also possible within the scope of the present invention to regenerate used wash solutions which, in addition to or in place of aluminum, also contain other dissolved metals, with copper-containing labels and the like being used more and more often. Labels for beverage containers, such as bottles, often also contain bronze pigments, such as so-called gold bronzes on a base of copper and zinc, or silver bronzes on a base of copper, zinc, and nickel, so that in addition to aluminum, other metals can also be drawn into and dissolved in used wash solutions; in addition to those already mentioned, other heavy metals such as iron and lead also can be present. Thus, an alkali hydroxide containing used wash solution produced in a bottle washing unit of a modern and multilayered beverage processing operation, for example, can contain the following metals in the indicated concentration ranges:

| | |
|---|---|
| Aluminum | 500 to 4000 mg/l |
| Copper | 100 to 250 mg/l |
| Zinc | 30 to 50 mg/l |
| Iron | 10 to 20 mg/l |
| Nickel | 0.2 to 0.5 mg/l |
| Lead | 1 to 2 mg/l |

Such a used wash solution also can be successfully regenerated with the method of the present invention. The same is true for an essentially metal-free used wash solution which has been exposed to the atmosphere and where only the sodium hydroxide which was used to form sodium carbonate has to be regenerated and the calcium carbonate has to be separated out.

The present invention is, of course, in no way restricted to the specific disclosure of the specification and drawing, but also encompasses any modifications within the scope of the appended claims.

What I claim is:

1. A method of regenerating wash solution for permanently maintaining wash force thereof and which contains sodium hydroxide and/or potassium hydroxide, and which is used during the mechanical cleaning of containers such as bottles; the wash solution contains, as impurities, dissolved aluminum, copper, or other heavy metals in the form of zinc, iron, nickel, or lead, which originated from the containers, and carbonates resulting during the cleaning, and organic substances which adhere to the containers; said method comprising the steps of:

adding directly to said impure wash solution at least one calcium compound in the form of one of the group consisting of solid calcium compounds and aqueous suspensions thereof, to thus form at least one precipitate to remove said impurities although maintaining wash force by having free alkali available therein; and separating said precipitate from said wash solution especially removing salts therefrom to produce regenerated wash solution.

2. A method according to claim 1, in which said at least one calcium compound which is added is a solid calcium compound.

3. A method according to claim 1, in which said calcium compound is an inorganic calcium compound.

4. A method according to claim 3, in which said calcium compound is calcium oxide.

5. A method according to claim 3, in which said calcium compound is calcium hydroxide.

6. A method according to claim 3, in which said calcium compound is selected from the group consisting of calcium chloride and calcium sulfate.

7. A method according to claim 1, in which said calcium compound is an organic calcium compound.

8. A method according to claim 7, in which said calcium compound is calcium acetate.

* * * * *